US007513798B2

(12) United States Patent
Smith

(10) Patent No.: US 7,513,798 B2
(45) Date of Patent: Apr. 7, 2009

(54) ELECTRICAL CONNECTOR HAVING VARYING OFFSET BETWEEN ADJACENT ELECTRICAL CONTACTS

(75) Inventor: Stephen B. Smith, Mechanicsburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/851,091

(22) Filed: Sep. 6, 2007

(65) Prior Publication Data

US 2009/0068899 A1 Mar. 12, 2009

(51) Int. Cl.
*H01R 13/648* (2006.01)

(52) U.S. Cl. ..... 439/608

(58) Field of Classification Search ..... 439/608, 439/941, 79, 701

See application file for complete search history.

(56) References Cited

U.S. PATENT DOCUMENTS

| | | | | |
|---|---|---|---|---|
| 5,795,191 | A * | 8/1998 | Preputnick et al. | 439/608 |
| 5,961,355 | A * | 10/1999 | Morlion et al. | 439/686 |
| 6,371,813 | B2 * | 4/2002 | Ramey et al. | 439/608 |
| 6,379,188 | B1 * | 4/2002 | Cohen et al. | 439/608 |
| 6,503,103 | B1 * | 1/2003 | Cohen et al. | 439/608 |
| 6,652,318 | B1 * | 11/2003 | Winings et al. | 439/608 |
| 6,808,399 | B2 | 10/2004 | Rothermel et al. | 439/108 |
| 7,040,901 | B2 * | 5/2006 | Benham et al. | 439/65 |
| 7,172,461 | B2 * | 2/2007 | Davis et al. | 439/608 |
| 7,195,497 | B2 * | 3/2007 | Hull et al. | 439/79 |
| 2006/0068640 | A1 * | 3/2006 | Gailus | 439/608 |
| 2006/0068641 | A1 * | 3/2006 | Hull et al. | 439/608 |
| 2007/0202747 | A1 * | 8/2007 | Sharf et al. | 439/608 |
| 2008/0096436 | A1 * | 4/2008 | Minich | 439/701 |

* cited by examiner

*Primary Examiner*—Neil Abrams
*Assistant Examiner*—Harshad C Patel
(74) *Attorney, Agent, or Firm*—Woodcock Washburn LLP

(57) ABSTRACT

Provided is an electrical connector that may reduce crosstalk between leadframe assemblies. Such a connector may have a connector housing, a first leadframe assembly contained in the housing, and a second leadframe assembly contained in the housing adjacent to the first leadframe assembly. The first leadframe assembly may have a first differential signal pair of electrically-conductive contacts. The second leadframe assembly may have a second differential signal pair of electrically-conductive contacts. Each contact of the first and second differential signal pairs may have a respective first portion, a second portion, and a third portion. Crosstalk generated on the second differential signal pair by a signal traveling through the first portions of the contacts of the first differential signal pair may be reduced by crosstalk generated on the second differential signal pair by the signal as it travels through the second portions of the contacts of the first differential signal pair.

20 Claims, 10 Drawing Sheets

ELECTRICAL CONNECTOR HAVING VARYING OFFSET BETWEEN ADJACENT ELECTRICAL CONTACTS

BACKGROUND

Electrical connectors provide signal connections between electronic devices using electrically-conductive contacts. Often, the signal contacts are so closely spaced relative to one another such that undesirable interference, or "crosstalk," occurs between neighboring signal contacts. Crosstalk may occur when a signal traveling through one contact induces electrical interference on another contact due to intermingling electric fields. Ground shields were often used to limit crosstalk between signal contacts in adjacent columns. Shieldless connectors are becoming the norm, however, even in high-speed electrical communications.

One known technique for limiting crosstalk in shieldless, high-speed electrical connectors is depicted in FIG. 1. As shown, the connector may include two (or more) adjacent columns of electrical contacts. Each contact 10 in the first column has a mounting portion 16, a mating portion 20, and a middle portion 18 extending between the mounting portion 16 and the mating portion 20. Similarly, each contact 14 in the second column has a mounting portion 22, a mating portion 26, and a middle portion 24 extending between the mounting portion 22 and the mating portion 26.

As shown, the mounting portions 22 of the contacts 14 are offset from the mounting portions 16 of the contacts 10 in a first direction (e.g., to the left as shown in FIG. 1), by an offset distance D. The offset distance D may be less than or equal to one row pitch. A "row pitch," as that term is used herein, refers to the distance between centerlines of adjacent rows of contacts. The mating portions 26 of the contacts 14 are offset from the mating portions 20 of the contacts 10 in a second direction (e.g., upward as shown in FIG. 1). The second direction is perpendicular to the first direction. The mating portions 26 of the contacts 14 are offset from the mating portions 20 of the contacts 10 by the offset distance D. The middle portions 24 of the contacts 14 are offset from the middle portions 18 of the contacts 10 in each of the first and second directions (e.g., upward and to the left as shown in FIG. 1).

FIGS. 2A-2C depict cross-sectional views of the contacts 10 and 14 taken through lines A-A, B-B, and C-C, respectively. In such a configuration, crosstalk generated on the one contact by signals traveling through the other will be the same in magnitude and phase throughout each portion of the contact.

SUMMARY

Disclosed is an electrical connector having a connector housing, a first leadframe assembly contained in the connector housing, and a second leadframe assembly contained in the connector housing adjacent to the first leadframe assembly. The first leadframe assembly may include a first dielectric leadframe housing and first differential signal pair of electrically-conductive contacts extending through the leadframe housing. The second leadframe assembly may include a second dielectric leadframe housing and second differential signal pair of electrically-conductive contacts extending through the leadframe housing.

Offset between the contacts of the first and second differential signal pairs may be varied, such that crosstalk generated on the second differential signal pair by a signal traveling through the contacts of the first differential signal pair may vary in phase as the signal travels through the contacts of the first differential signal pair. Therefore, crosstalk generated on the second differential signal pair as the signal travels through a first portion of the contacts of the first differential signal pair may be reduced by crosstalk generated on the second differential signal pair as the signal travels through a second portion of the contacts of the first differential signal pair.

In an example embodiment, each contact of the first and second differential signal pairs may have a mounting portion, a mating portion, and a middle portion extending between the mounting portion and the mating portion. The mounting portions of the contacts of the first differential signal pair may be longer than the mounting portions of the contacts of the second differential signal pair. The mating portions of the contacts of the first differential signal pair may be longer than the mating portions of the contacts of the second differential signal pair. The middle portions of the contacts of the first differential signal pair may be shorter than the middle portions of the contacts of the second differential signal pair. Thus, crosstalk generated on the second differential signal pair by a signal traveling through the mating and mounting portions of the contacts of the first differential signal pair may be reduced by crosstalk generated on the second differential signal pair as the signal travels through the middle portions of the contacts of the first differential signal pair.

DETAILED DESCRIPTION OF ILLUSTRATIVE EMBODIMENTS

Figure 1:
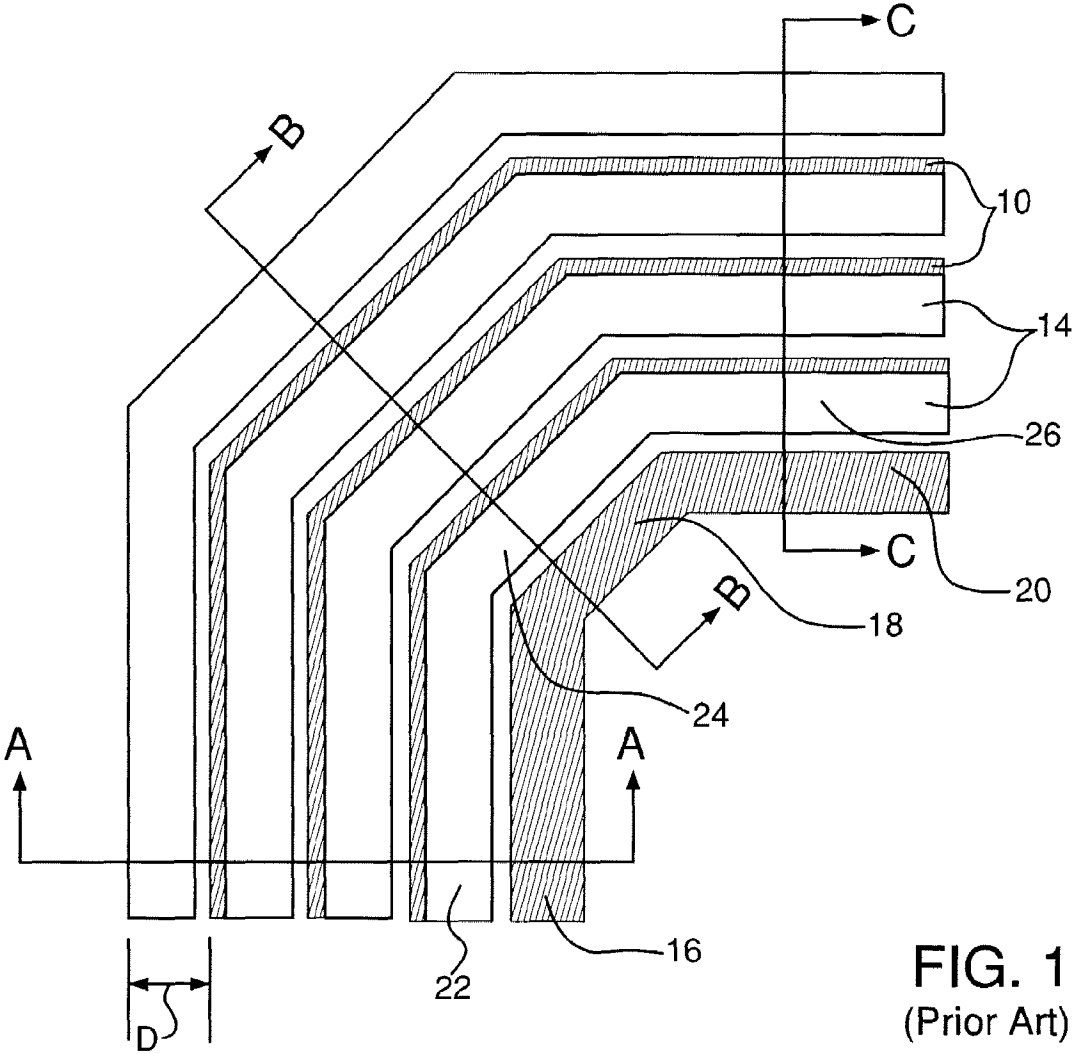
FIG. 1 (Prior Art)
FIG. 1 is a schematic of a side view of a known set of electrically-conductive contacts.
Figure 2B:
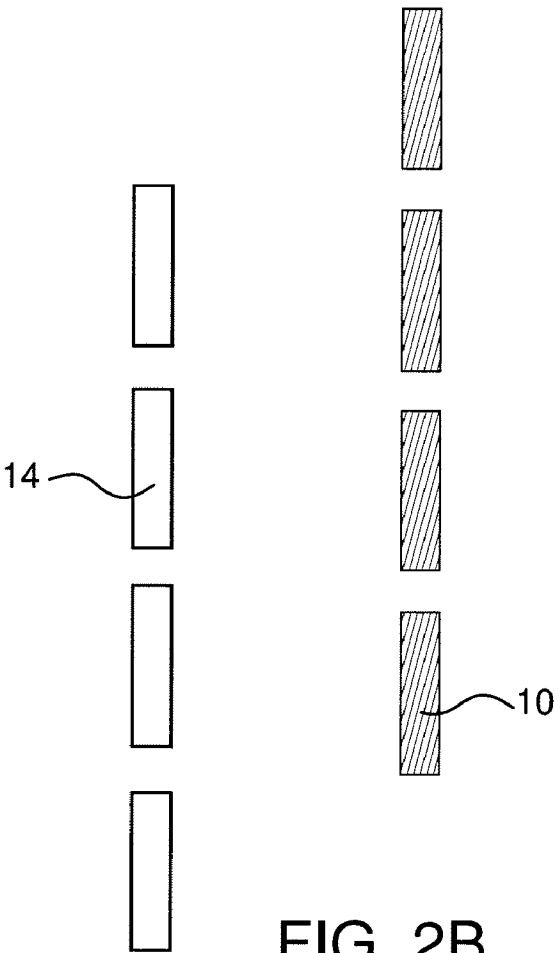
FIG. 2B (Prior Art)
FIGS. 2A-2C are cross-sectional views through lines A-A, B-B, and C-C, respectively, for the set of contacts shown in FIG. 1.
Figure 2A:
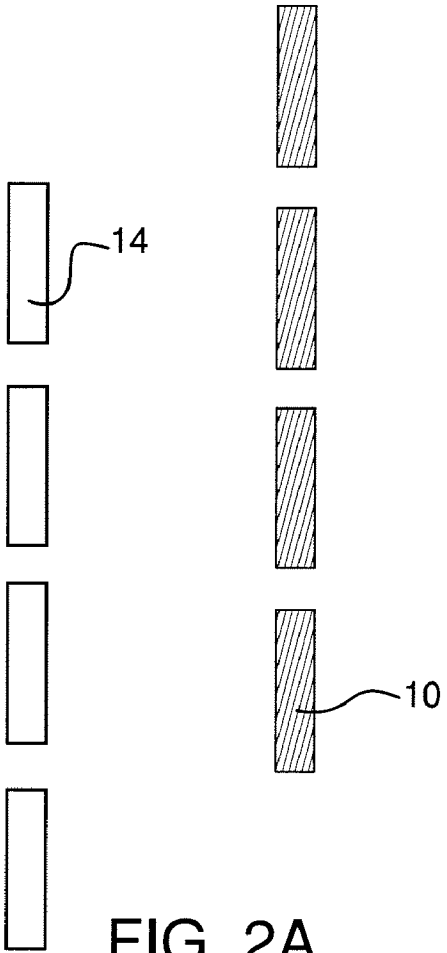
FIG. 2A (Prior Art)
Figure 2C:
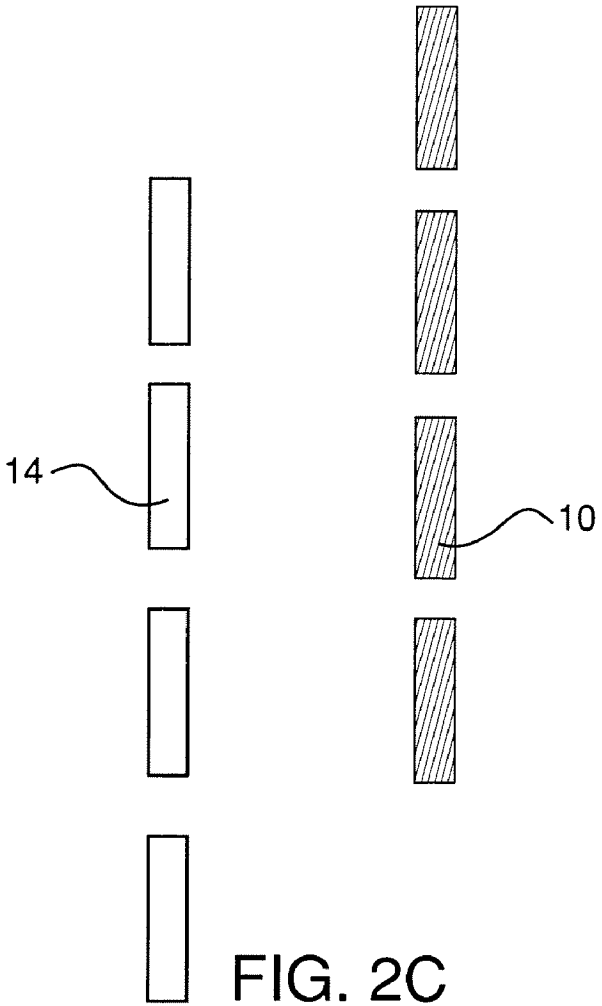
FIG. 2C (Prior Art)
Figure 3:
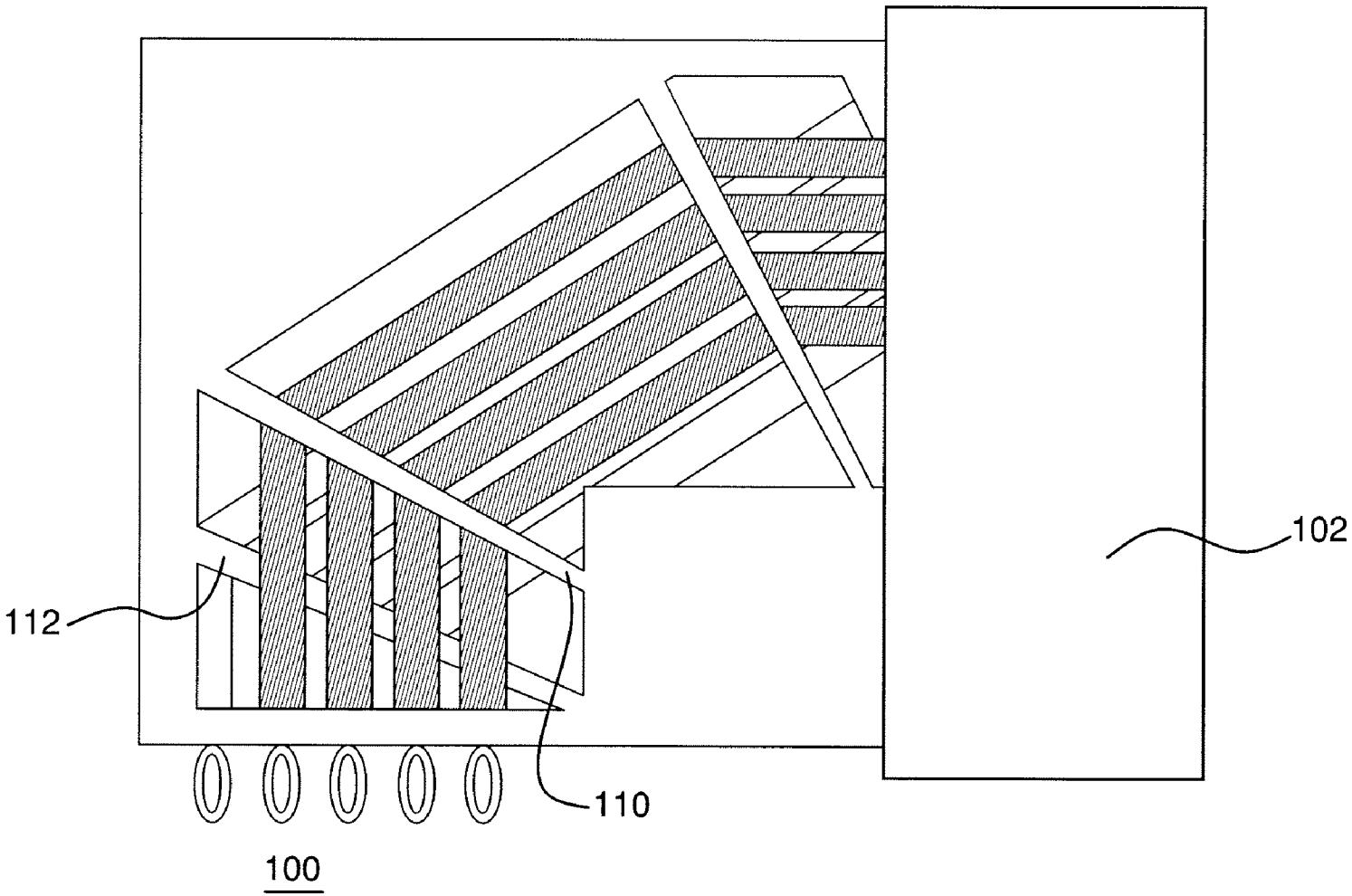
FIG. 3 is a side view of an example embodiment of a connector.

FIG. 3 depicts a side view of a right-angle electrical connector 100. The right-angle electrical connector 100 may be mounted to a substrate, such as a circuit board, for example.

The right-angle electrical connector 100 may include a connector housing 102, and a plurality of leadframe assemblies 110 and 112 contained in the connector housing 102. The connector housing 102 may be made of a dielectric material, such as plastic for example. The connector housing 102 may be injection molded. The leadframe assemblies 110 and 112 may be insert molded leadframe assemblies (IMLAs). As depicted, leadframe assembly 110 may be positioned adjacent to leadframe assembly 112.

Figure 4:
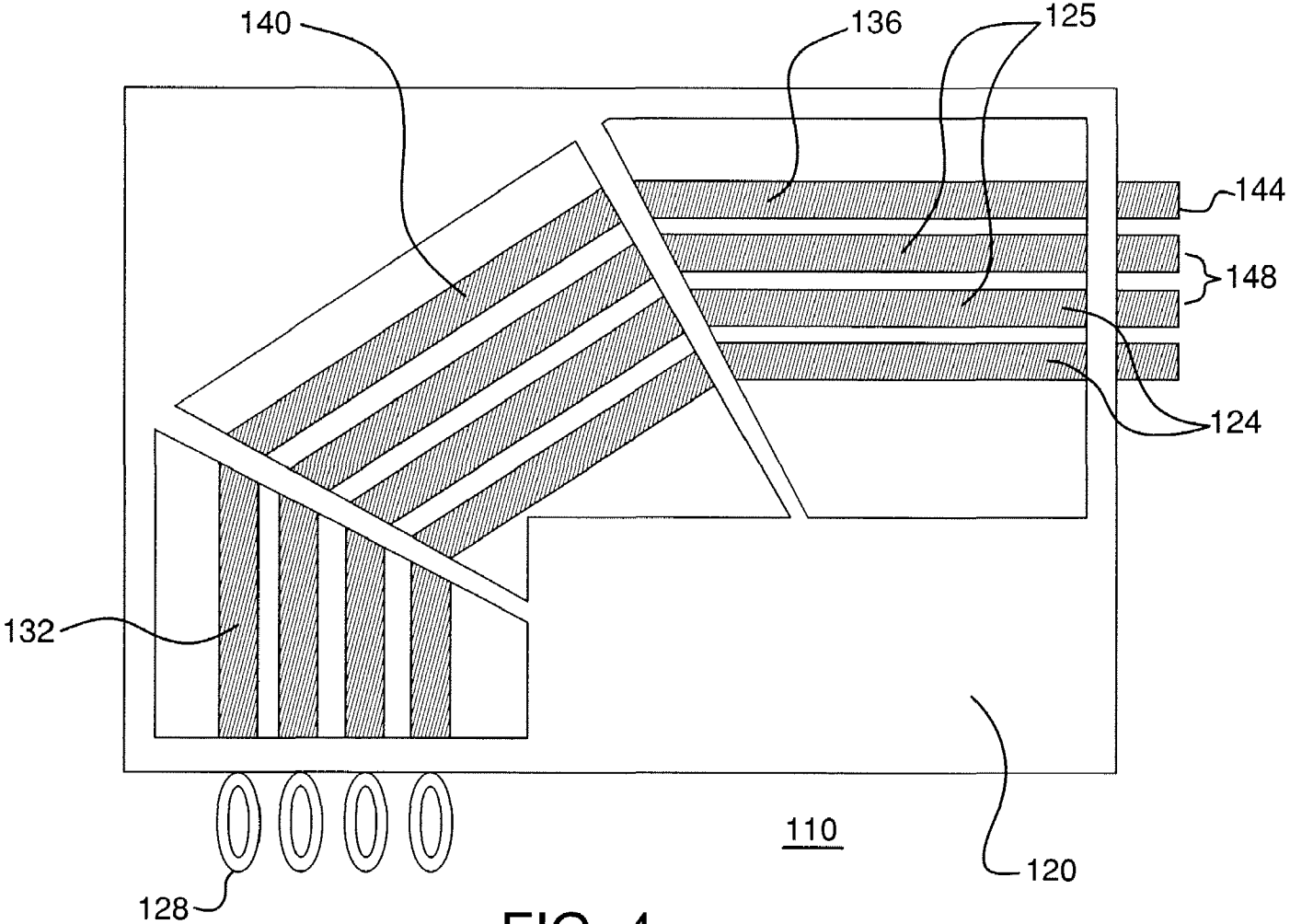
FIG. 4 is a side view of an example embodiment of a first-embodiment insert molded leadframe assembly.

FIG. 4 depicts an example embodiment of a leadframe assembly 110. The leadframe assembly 110 may include a dielectric leadframe housing 120. One or more electrically-conductive contacts 124 may extend through the leadframe housing 120. The leadframe housing 120 may retain the one or more electrically-conductive contacts 124. The leadframe housing 120 may be insert-molded over a leadframe of electrically-conductive contacts. Each electrically-conductive contact 124 may be made of electrically-conductive material, such as metal for example. The electrically conductive contacts 124 may define a column of contacts.

Each electrically-conductive contact 124 may include a mounting end 128, a mounting portion 132, a mating portion 136, a middle portion 140, and a mating end 144. The mounting ends 128 of the electrically-conductive contacts 124 may be in any configuration suitable for mounting to a substrate. For example, the mounting ends 128 may be an eye-of-the-needle configuration. Also, for example, the mounting ends 128 may include a solder ball connector suitable for a ball grid array mount.

Contacts 124 may define a differential signal pair 125, which in turn may define a transmission path 148. As depicted, the middle portion 140 of each contact 124 may extend between a respective mounting portion 132 and a respective mating portion 136. The mounting portions 132, the mating portions 136, and the middle portions 140 may be different lengths. Therefore, the mounting portions 132, the mating portions 136, and the middle portions 140 are not limited to the lengths or configurations depicted in FIG. 4.

The mating ends 144 of the electrically-conductive contacts 124 may be any configuration suitable for mating with a complementary connector. For example, the mating ends 144 may be blade shaped or define a receptacle. The mating ends 144 of the electrically-conductive contacts 124 may extend in a direction perpendicular to the mounting ends 128 of the electrically-conductive contacts 124. For example, when the insert molded leadframe assembly 110 is mounted to the substrate, the mounting ends 128 may be oriented perpendicular to a plane defined by the upper surface of the substrate, and the mating ends 144 may extend parallel to the plane defined by the upper surface of the substrate.

Figure 5:
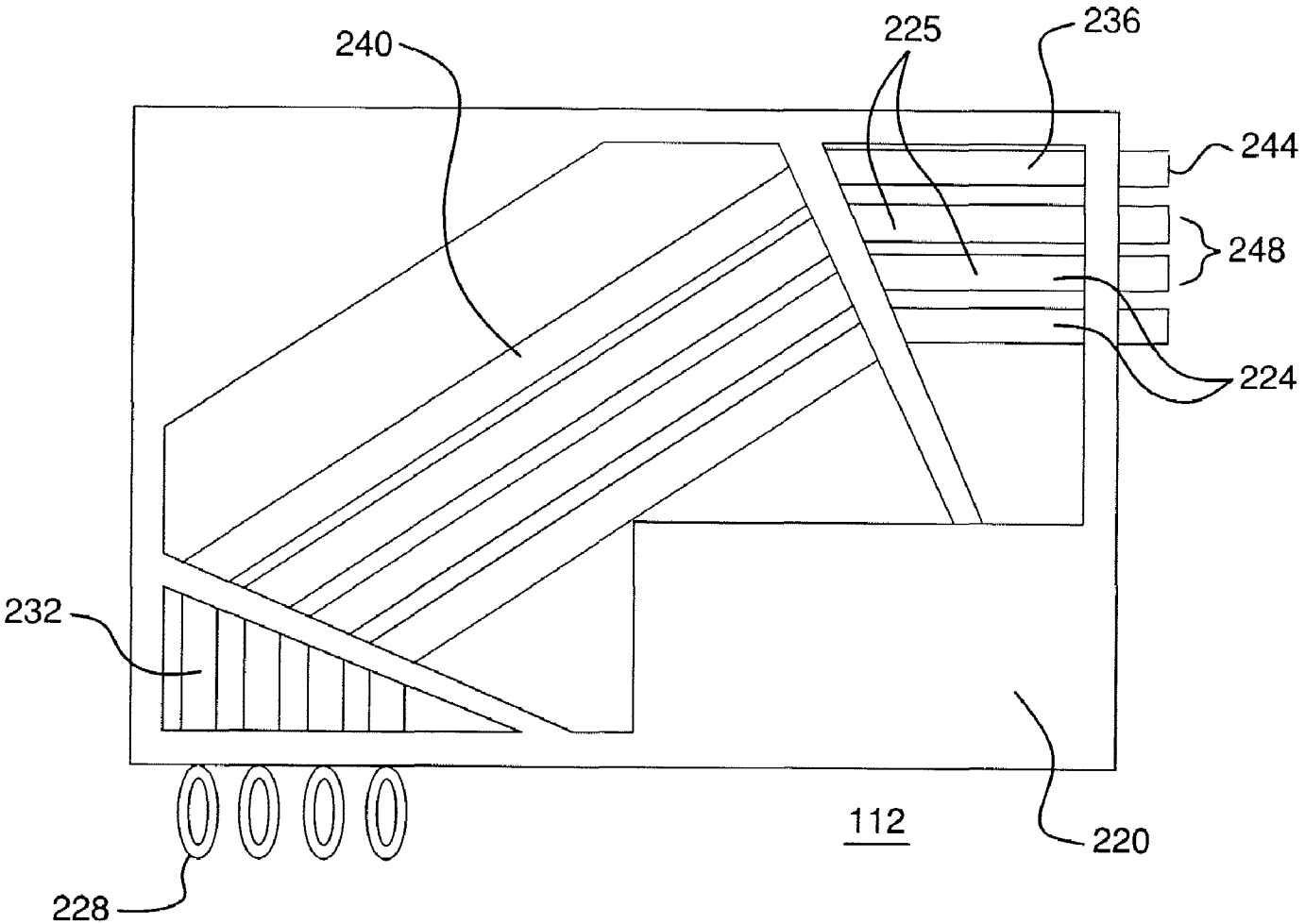
FIG. 5 is a side view of an example embodiment of a second-embodiment insert molded leadframe assembly.

FIG. 5 depicts an example embodiment of a leadframe assembly 112. The leadframe assembly 112 may include a dielectric leadframe housing 220. One or more electrically-conductive contacts 224 may extend through the leadframe housing 220. The leadframe housing 220 may retain the one or more electrically-conductive contacts 224. The leadframe housing 220 may be insert-molded over a leadframe of electrically-conductive contacts. Each electrically-conductive contact 224 may be made of electrically-conductive material, such as metal for example. The electrically conductive contacts 224 may define a column of contacts.

Each electrically-conductive contact 224 may include a mounting end 228, a mounting portion 232, a mating portion 236, a middle portion 240, and a mating end 244. The mounting ends 228 of the electrically-conductive contacts 224 may be in any configuration suitable for mounting to a substrate. For example, the mounting ends 228 may be an eye-of-the-needle configuration. Also, for example, the mounting ends 228 may include a solder ball connector suitable for a ball grid array mount.

Contacts 224 may define a differential signal pair 225, which in turn may define a transmission path 248. As depicted, the middle portion 240 of each contact 224 may extend between a respective mounting portion 232 and a respective mating portion 236. The mounting portions 232, the mating portions 236, and the middle portions 240 may be different lengths. Therefore the mounting portions 232, the mating portions 236, and the middle portions 240 are not limited to the lengths or configurations depicted in FIG. 5.

The mating ends 244 of the electrically-conductive contacts 224 may be any configuration suitable for mating with a complementary connector. For example, the mating ends 244 may be blade shaped or define a receptacle. The mating ends 244 of the electrically-conductive contacts 224 may extend in a direction perpendicular to the mounting ends 228 of the electrically-conductive contacts 224. For example, when the insert molded leadframe assembly 112 is mounted to the substrate, the mounting ends 228 may be oriented perpendicular to a plane defined by the upper surface of the substrate, and the mating ends 244 may extend parallel to the plane defined by the upper surface of the substrate.

When the leadframe assemblies 110 and 112 are positioned in the connector housing 102, the mounting ends 128 and 228 may define a plane. The plane defined by the mounting ends 128 and 228 may be perpendicular to a plane defined by the mating ends 144 and 244. Such an arrangement is not required, however, and some mating ends may be shorter or longer than other mating ends.

The contacts 124 that form the differential signal pair 125 may be coupled, and the contacts 224 that form the differential signal pair 225 may be coupled. For example, the contacts 124 that form the differential signal pair 125 may be edge coupled, and the contacts 224 that form the differential signal pair 225 may be edge coupled.

When each leadframe assembly 110 and each leadframe assembly 112 is positioned in the connector housing 102, the mounting ends 128 and 228 may define rows of mounting ends. Additionally, the mating ends 144 and 244 may define columns of mating ends.

Figure 6:
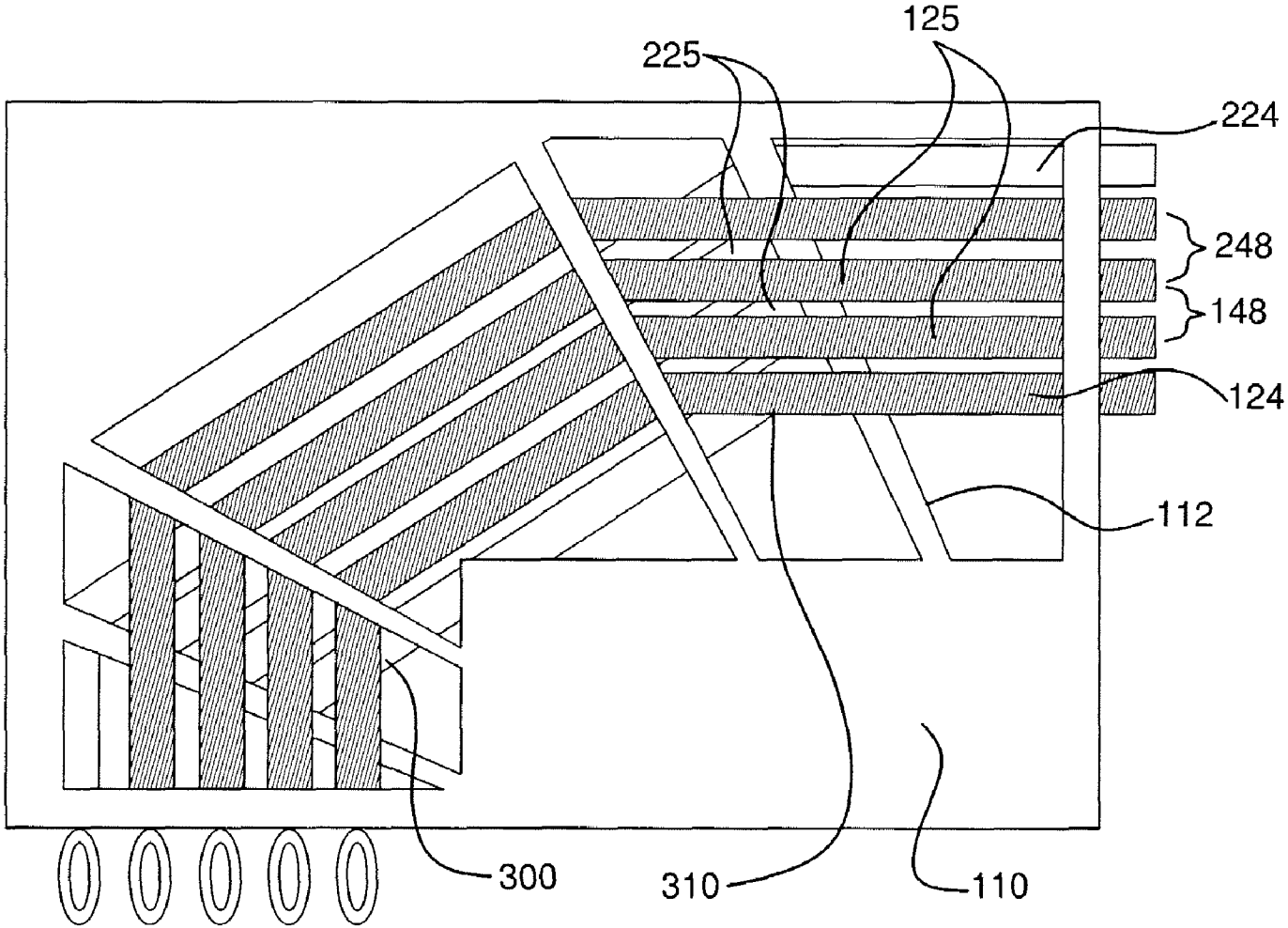
FIG. 6 is a side view depicting the leadframe assembly of FIG. 4 positioned adjacent to the leadframe assembly of FIG. 5.

FIG. 6 depicts leadframe assembly 110 positioned adjacent to leadframe assembly 112. As depicted, the transmission paths 148 of contacts 124 are different from respective transmission paths 248 of contacts 224. Therefore, when leadframe assembly 110 is positioned adjacent to leadframe assembly 112, offset between each contact 124 and each respective contact 224 may be achieved without offsetting the leadframe assemblies 110 and 112 relative to one another. It should be understood, of course, that the leadframe assemblies may be offset relative to one another. As depicted, each of the contacts 124 may be offset from a respective contact 224 at, at least two different points. That is, the transmission path 148 defined by the differential signal pair 125 may cross the transmission path 248 defined by differential signal pair 225 at a first point 300 and at a second point 310. An air dielectric may be created at the intersection of the transmission paths 148, and 248, such as at the first point 300 and the second point 310 to reduce capacitive coupling.

Figure 7:
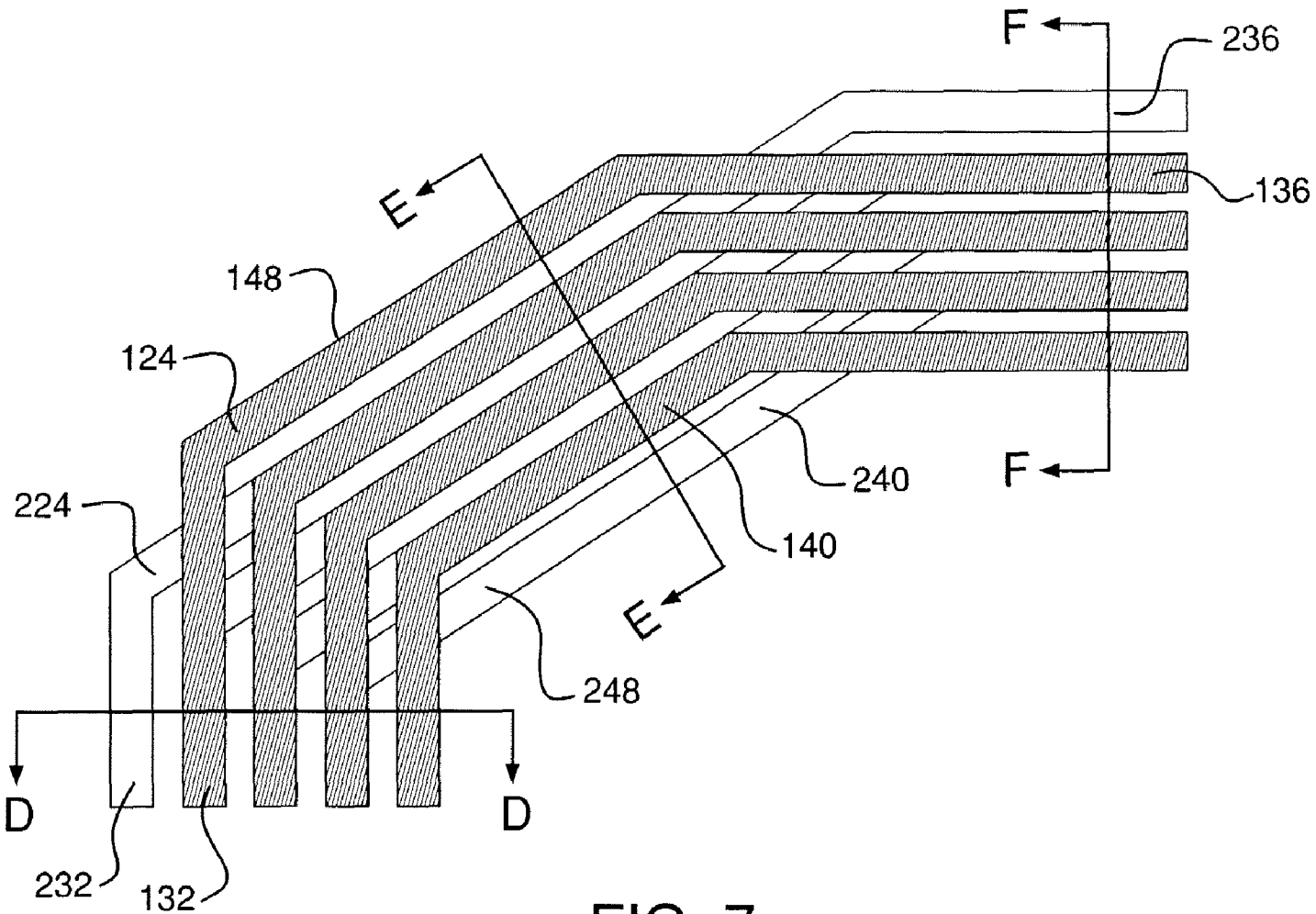
FIG. 7 is a side view of the leadframe assemblies of FIG. 5 without the leadframe housings.

FIG. 7 depicts the leadframe assemblies 110 and 112 of FIG. 6 with their dielectric housings removed. As shown, each mounting portion 132 of contacts 124 may be longer than each respective mounting portion 232 of contacts 224. Additionally, each mating portion 136 of contacts 124 may be longer than each respective mating portion 236 of contacts 224. Finally, each middle portion 140 of contacts 124 may be shorter than each respective middle portion 240 of contacts 224.

FIG. 7 also depicts that the contacts 124 and 224 may be offset from each other in multiple directions for different portions of the contacts 124 and 224. As depicted, each mounting portion 132 may be offset to the right of a respective mounting portion 232, each mating portion 136 may be offset below a respective mating portion 236, and each middle portion 140 may be offset above and to the left of a respective middle portion 240. It should be appreciated that the offsets are not limited to those depicted in FIG. 7. For example, the transmission paths 148 may cross the transmission paths 248 at different points or the offsets may be in different directions.

Figure 8B:
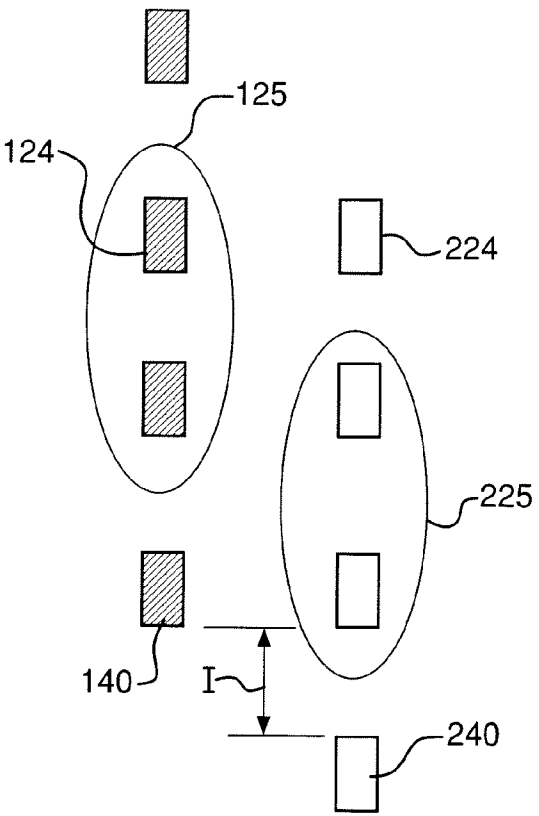
FIGS. 8A-8C are cross-sectional views through lines D-D, E-E, and F-F, respectively, of the set of contacts shown in FIG. 7.
Figure 8A:
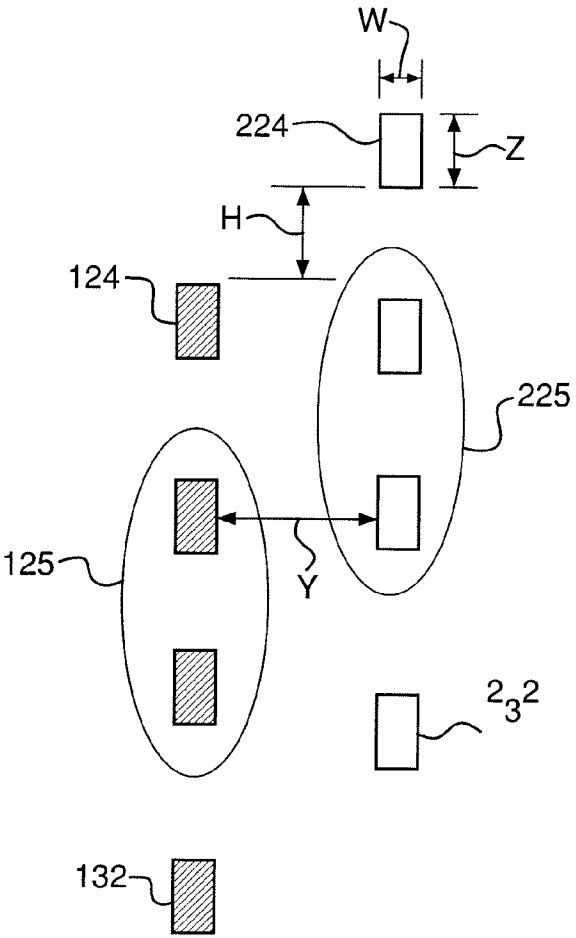

FIG. 8A is a cross-sectional view through the line D-D shown in FIG. 7. As shown, each mounting portion 132 of contacts 124 may be offset from each mounting portion 232 of contacts 224. As shown, the mounting portions 132 may be offset from the mounting portions 232 by a distance H. For example, the mounting portion 132 may be offset from the mounting portions 232 by one row pitch. The mounting portions 132 and 232 are not limited to the depicted offset, however, and may be offset by a different amount.

As depicted, each of the contacts 124 and 224 may have a width Z and a thickness W. For example each contact may have a width of about 0.4-1.05 mm and a thickness of about 0.2-0.4 mm. Additionally, the column of contacts 124 may be positioned a distance of Y apart from the column of contacts 224. For example, the contacts 124 may be positioned a distance of about 1.5-3.0 mm or more from the contacts 224.

FIG. 8B is a cross-sectional view through the line E-E shown in FIG. 7. As shown, each middle portion 140 of contacts 124 may be offset from each middle portion 240 of contacts 224. As shown, the middle portions 140 may be offset from the middle portions 240 by a distance I. For example the middle portion 140 may be offset from the middle portions 240 by one row pitch. The middle portions 140 and 240 are not limited to the depicted offset, however, and may be offset by a different amount.

Figure 8C:
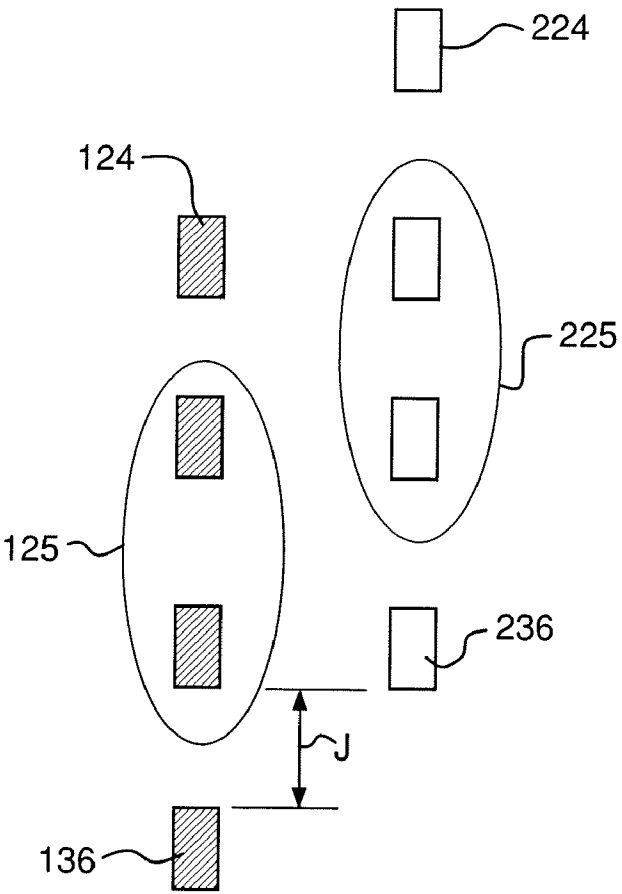

FIG. 8C is a cross-sectional view through the line F-F shown in FIG. 7. As shown, each mating portion 136 of contacts 124 may be offset from each mating portion 236 of contacts 224. As shown, the mating portions 136 may be offset from the mating portions 236 by a distance J. For example, the mating portions 136 may be offset from the mating portions 236 by one row pitch. The mating portions 136, 236 are not limited to the depicted offset and may be offset by a different amount, such as distance H.

Crosstalk may be reduced because of a phase change in the crosstalk as the differential signal travels through the transmission paths 148 and 248 defined by the differential pairs 125 and 225. This phase change can be accomplished by changing the relative position of adjacent differential signal pairs with respect to each other along the transmission path. In one embodiment, the electrical length of one middle portion 140 of one contact 124 in differential signal pair 125 may be approximately equal to a sum of the electrical lengths of the mounting and mating portions of the contact 224 in differential signal pair 225. Similarly, the electrical length of one middle portion 240 of one contact 224 in differential signal pair 225 may be approximately equal to a sum of the electrical lengths of the mounting and mating portions of one contact in differential signal pair 125.

What is claimed:

1. An electrical connector comprising:

a connector housing;

a first leadframe assembly positioned in the connector housing, the first leadframe assembly comprising a first dielectric leadframe housing and a first differential signal pair of electrically-conductive contacts extending through the first leadframe housing; and a second leadframe assembly positioned in the connector housing adjacent to the first leadframe assembly, the second leadframe assembly comprising a second dielectric leadframe housing and a second differential signal pair of electrically-conductive contacts extending through the second leadframe housing, wherein (i) each of the contacts of the first differential signal pair defines a respective first mounting portion, a first mating portion, and a first middle portion extending between the first mounting portion and the first mating portion, (ii) each of the contacts of the second differential signal pair defines a respective second mounting portion, a second mating portion, and a second middle portion extending between the second mounting portion and the second mating portion, (iii) the first mounting portions are longer than the second mounting portions, (iv) the first mating portions are longer than the second mating portions, and (v) the first middle portions are shorter than the second middle portions.

2. The electrical connector of claim 1, wherein (i) each of the contacts of the first and second differential signal pairs has a mating end, and (ii) the mating ends of the contacts of the first differential signal pair are offset from the mating ends of the contacts of the second differential signal pair in a first direction.

3. The electrical connector of claim 2, wherein the first middle portions are offset from the second middle portions in a second direction opposite the first direction.

4. The electrical connector of claim 1, wherein (i) each of the contacts of the first and second differential signal pairs has a mounting end, and (ii) the mounting ends of the contacts of the first differential signal pair are offset from the mounting ends of the contacts of the second differential pair.

5. The electrical connector of claim 1, wherein the mounting portions of the contacts of the first and second differential signal pairs define rows.

6. The electrical connector of claim 1, wherein crosstalk generated on the second differential signal pair by a signal traveling through the first mating portions is reduced by crosstalk generated on the second differential signal pair by the signal as it travels through the first middle portions.

7. The electrical connector of claim 6, wherein (i) the crosstalk generated on the second differential signal pair by the signal traveling through the first mating portions has a first phase, (ii) the crosstalk generated on the second differential signal pair by the signal as it travels through the first middle portions has a second phase, and (iii) the first phase is out of phase with the second phase.

8. The electrical connector of claim 1, wherein crosstalk generated on the second differential signal pair by a signal traveling through the first mounting portions is reduced by crosstalk generated on the second differential signal pair by the signal as it travels through the first middle portions.

9. The electrical connector of claim 8, wherein (i) the crosstalk generated on the second differential pair by the signal traveling through the first mounting portions has a first phase, (ii) the crosstalk generated on the second differential signal pair by the signal as it travels through the first middle portions has a second phase, and (iii) the first phase is out of phase with the second phase.

10. An electrical connector comprising:

a connector housing;

a first leadframe assembly positioned in the connector housing, the first leadframe assembly comprising a first dielectric leadframe housing and a first differential signal pair of electrically-conductive contacts extending through the first leadframe housing; and a second leadframe assembly positioned in the connector housing adjacent to the first leadframe assembly, the second leadframe assembly comprising a second dielectric leadframe housing and a second differential signal pair of electrically-conductive contacts extending through the second leadframe housing, wherein (i) each of the contacts of the first differential signal pair defines a respective first portion thereof, a second portion thereof, and a third portion thereof extending between the first and second portions thereof, (ii) each of the contacts of the second differential signal pair defines a respective first portion thereof, a second portion thereof, and a third portion thereof extending between the first and second portions thereof, (iii) the first portions of the contacts of the first differential signal pair are offset from the first portions of the contacts of the second differential signal pair in a first direction, and (iv) the third portions of the contacts of the first differential signal pair are offset from the third portions of the contacts of the second differential signal pair in a second direction that has a directional component that is opposite to the first direction.

11. The electrical connector of claim 10, wherein crosstalk generated on the second differential signal pair by a signal traveling through the first portions of the contacts of the first differential signal pair is reduced by crosstalk generated on the second differential signal pair by the signal as it travels through the third portions of the contacts of the first differential signal pair.

12. The electrical connector of claim 10, wherein crosstalk generated on the second differential signal pair by a signal traveling through the second portions of the contacts of the first differential signal pair is reduced by crosstalk generated on the second differential signal pair by the signal as it travels through the third portions of the contacts of the first differential signal pair.

13. The electrical connector of claim 10, wherein the third portions of the contacts of the first differential signal pair are shorter than the third portions of the contacts of the second differential signal pair.

14. The electrical connector of claim 10, wherein the first portions of the contacts of the first differential signal pair are longer than the first portions of the contacts of the second differential signal pair.

15. The electrical connector of claim 10, wherein the second portions of the contacts of the first differential signal pair are longer than the second portions of the contacts of the second differential signal pair.

16. An electrical connector comprising:

a connector housing;

a first leadframe assembly positioned in the connector housing, the first leadframe assembly comprising a first dielectric leadframe housing and a first differential signal pair of electrically-conductive contacts extending through the first leadframe housing; and a second leadframe assembly positioned in the connector housing adjacent to the first leadframe assembly, the second leadframe assembly comprising a second dielectric leadframe housing and a second differential signal pair of electrically-conductive contacts extending through the second leadframe housing, wherein crosstalk generated on the second differential signal pair by a signal traveling through first portions of the contacts of the first differential signal pair is reduced by crosstalk generated on the second differential signal pair by the signal as it travels through second portions of the contacts of the first differential signal pair, and wherein (i) the first portions of the contacts of the first differential signal pair are longer than the first portions of the contacts of the second differential signal pair, (ii) the second portions of the contacts of the first differential signal pair are longer than the second portions of the contacts of the second differential signal pair, (iii) the contacts of the first and second differential signal pairs further include third portions, and (iv) the third portions of the contacts of the second differential signal pair are longer than the third portions of the contacts of the first differential signal pair.

17. The electrical connector of claim 16, wherein crosstalk generated on the second differential signal pair by a signal traveling through the first portions of the contacts of the first differential signal pair is reduced by crosstalk generated on the second differential signal pair by the signal as it travels through the third portions of the contacts of the first differential signal pair.

18. The electrical connector of claim 16, wherein (i) the crosstalk generated on the second differential signal pair by the signal traveling through the first portions of the contacts of the first differential signal pair has a first phase, (ii) the crosstalk generated on the second differential signal pair by the signal as it travels through the third portions of the contacts of the first differential signal pair has a second phase, and (iii) the first phase is out of phase with the second phase.

19. The electrical connector of claim 16, wherein (i) the first portions of the contacts of the first differential signal pair are offset from the first portions of the contacts of the second differential signal pair in a first direction; and (ii) the second portions of the contacts of the first differential signal pair are offset from the second portions of the contacts of the second differential signal pair in a second direction, that has a directional component that is opposite the first direction.

20. An electrical connector comprising:

a connector housing;

a first leadframe assembly positioned in the connector housing, the first leadframe assembly comprising a first dielectric leadframe housing and a first differential signal pair of electrically-conductive contacts extending through the first leadframe housing; and a second leadframe assembly positioned in the connector housing adjacent to the first leadframe assembly, the second leadframe assembly comprising a second dielectric leadframe housing and a second differential signal pair of electrically-conductive contacts extending through the second leadframe housing, wherein crosstalk generated on the second differential signal pair by a signal traveling through first portions of the contacts of the first differential signal pair is reduced by crosstalk generated on the second differential signal pair by the signal as it travels through second portions of the contacts of the first differential signal pair, and wherein (i) the first portions of the contacts of the first differential signal pair are offset from the first portions of the contacts of the second differential signal pair in a first direction; and (ii) the second portions of the contacts of the first differential signal pair are offset from the second portions of the contacts of the second differential signal pair in a second direction, that has a directional component that is opposite the first direction.

* * * * *